US012595100B2

(12) United States Patent
Krautkrämer

(10) Patent No.: US 12,595,100 B2
(45) Date of Patent: Apr. 7, 2026

(54) CLOSURE DEVICE WITH SUPPORT RING

(71) Applicant: BERICAP Holding GmbH, Budenheim (DE)

(72) Inventor: Alexander Krautkrämer, Eltville (DE)

(73) Assignee: BERICAP Holding GmbH, Budenheim (DE)

( * ) Notice: Subject to any disclaimer, the term of this patent is extended or adjusted under 35 U.S.C. 154(b) by 47 days.

(21) Appl. No.: 18/681,184

(22) PCT Filed: Sep. 26, 2022

(86) PCT No.: PCT/EP2022/076607
§ 371 (c)(1),
(2) Date: Feb. 5, 2024

(87) PCT Pub. No.: WO2023/052273
PCT Pub. Date: Apr. 6, 2023

(65) Prior Publication Data

US 2025/0128865 A1 Apr. 24, 2025

(30) Foreign Application Priority Data

Oct. 1, 2021 (DE) ..... 10 2021 125 520.1

(51) Int. Cl.
*B65D 55/16* (2006.01)
*B65D 1/02* (2006.01)
(Continued)

(52) U.S. Cl.
CPC ..... *B65D 55/16* (2013.01); *B65D 1/0246* (2013.01); *B65D 5/747* (2013.01); *B65D 41/3428* (2013.01)

(58) Field of Classification Search
CPC ..... B65D 41/3428; B65D 2401/15; B65D 2401/30; B65D 47/103
(Continued)

(56) References Cited

U.S. PATENT DOCUMENTS 3,282,477 A * 11/1966 Henchert ..... B65D 47/148 222/541.9
3,419,198 A * 12/1968 Pettersen ..... B65D 47/141 220/254.5
(Continued)

FOREIGN PATENT DOCUMENTS

DE 69622745 T2 11/2002
DE 102016224222 B4 12/2018
(Continued)

OTHER PUBLICATIONS

International Search Report and Written Opinion issued on Jan. 27, 2023, in corresponding application No. PCT/EP2022/076607; 14 pages.
(Continued)

*Primary Examiner* — Steven A. Reynolds
*Assistant Examiner* — Prince Pal
(74) *Attorney, Agent, or Firm* — Maier & Maier, PLLC

(57) ABSTRACT

A closure device for closing a container. The closure device includes a basic member, a closure cap, an anchor ring and a connecting device. The basic member has an additional support arranged axially between a fastener and a first guide. The support has a first surface element with a surface normal which points in the direction of a pouring plane. The closure device is configured such that, in the open state of the closure device, the closure cap can be brought into a first position in which the closure cap abuts neither against the first surface element nor against a first edge bounding the first surface element, and can be brought into a second position in which the closure cap abuts against the first surface element or against the first edge or against the first surface element and the first edge.

17 Claims, 6 Drawing Sheets

(51) Int. Cl.
*B65D 5/74* (2006.01)
*B65D 41/34* (2006.01)

(58) Field of Classification Search
USPC ..... 215/235; 220/270
See application file for complete search history.

(56) References Cited

U.S. PATENT DOCUMENTS 3,459,315 A * 8/1969 Labarre ..... B65D 47/36 222/541.9
4,022,357 A * 5/1977 Dwinell ..... B65D 47/103 222/541.9
4,294,382 A * 10/1981 Summers ..... B65D 47/123 222/541.9
4,356,939 A * 11/1982 Fitte ..... B65D 47/103 222/541.9
4,682,702 A * 7/1987 Gach ..... B65D 51/20 222/541.9
4,727,999 A * 3/1988 Gach ..... B65D 47/103 215/254
4,747,498 A * 5/1988 Gach ..... B65D 51/20 215/346
5,123,561 A * 6/1992 Gross ..... B65D 47/0838 222/153.07
5,735,426 A * 4/1998 Babcock ..... B65D 5/746 215/354
5,810,184 A * 9/1998 Adams ..... B65D 5/746 215/45
5,934,496 A * 8/1999 Mogard ..... B65D 47/103 220/837
5,957,312 A * 9/1999 Adams ..... B65D 47/103 229/125.05
5,992,659 A * 11/1999 Nofer ..... B65D 41/0471 222/541.9
6,129,228 A * 10/2000 Adams ..... B31B 50/84 229/125.05
6,179,147 B1 * 1/2001 Mogard ..... B65D 47/103 222/541.9
6,390,342 B1 * 5/2002 Mabee ..... B65D 47/103 222/541.9
7,413,097 B1 * 8/2008 Adams ..... B65D 47/103 229/125.05
D626,410 S * 11/2010 Lohrman ..... D9/438
D636,671 S * 4/2011 Lohrman ..... D9/438
8,066,141 B2 * 11/2011 Casale ..... B65D 5/749 229/123.2
8,113,374 B2 * 2/2012 Steiger ..... B65D 47/0809 220/258.2
8,678,215 B2 * 3/2014 Steiger ..... B65D 47/103 215/382
9,598,209 B1 * 3/2017 Maldonado ..... B65D 47/122
9,963,274 B2 * 5/2018 Brunner ..... B65D 41/50
10,138,043 B2 * 11/2018 Mazurkiewicz ... B65D 47/0857
10,954,023 B2 * 3/2021 Winberg ..... B65D 5/065
11,174,078 B2 * 11/2021 Krautkrämer ..... B65D 39/0005
11,697,534 B2 * 7/2023 Bassi ..... B26D 7/06 215/243
11,697,535 B2 * 7/2023 Falzoni ..... B65D 41/34 215/306
11,708,191 B2 * 7/2023 Silla ..... B65D 55/16 215/200
11,718,450 B2 * 8/2023 Berroa García ... B65D 41/3428 215/243
11,801,977 B1 * 10/2023 Gray ..... B65D 47/0804
12,065,295 B2 * 8/2024 Migas ..... B65D 47/103
12,214,935 B2 * 2/2025 Falzoni ..... B65D 55/16
12,304,702 B2 * 5/2025 Menozzi ..... B65D 47/0838
12,351,373 B2 * 7/2025 Forrest ..... B65D 50/046
2001/0015355 A1 * 8/2001 Adams ..... B65D 47/103 220/259.3
2003/0071042 A1 * 4/2003 Adams ..... B65D 47/103 222/541.9
2004/0217083 A1 * 11/2004 Mavin ..... B65D 47/103 215/253
2005/0092750 A1 * 5/2005 Lohrman ..... B65D 47/36 215/254
2005/0205618 A1 * 9/2005 Mabee ..... B65D 47/0814 222/541.9
2006/0000793 A1 * 1/2006 Mavin ..... B65D 47/103 222/153.07
2006/0138137 A1 * 6/2006 Casale ..... B65D 5/749 220/259.3
2006/0289376 A1 * 12/2006 Von Spreckelsen ..... B65D 47/103 215/257
2008/0078765 A1 * 4/2008 Steiger ..... B65D 47/0804 220/345.1
2008/0078775 A1 * 4/2008 Steiger ..... B65D 51/20 220/361
2010/0140268 A1 * 6/2010 Lohrman ..... B65D 47/103 220/270
2013/0020327 A1 * 1/2013 Park ..... B65D 47/0838 220/745
2014/0263149 A1 * 9/2014 Berge ..... B65D 41/3423 215/44
2014/0263474 A1 * 9/2014 Skillin ..... B65D 75/5883 222/541.9
2015/0217910 A1 * 8/2015 Vogel ..... B65D 47/40 222/111
2016/0023819 A1 * 1/2016 Maldonado ..... B65D 47/103 222/541.9
2017/0096273 A1 * 4/2017 Mazurkiewicz ..... B65D 35/02
2019/0009943 A1 * 1/2019 Komet ..... B65D 1/0246
2019/0329938 A1 * 10/2019 Krautkrämer ..... B65D 39/0005
2019/0344933 A1 * 11/2019 Kim ..... B65D 41/3447
2020/0140154 A1 * 5/2020 Taylor ..... B65D 50/045
2020/0198850 A1 * 6/2020 Iniesta ..... B65D 47/043
2020/0283201 A1 * 9/2020 Migas ..... B65D 1/0246
2020/0339312 A1 * 10/2020 Krautkrämer ..... B67D 3/0032
2020/0369446 A1 * 11/2020 Mélan-Moutet ... B65D 41/3447
2020/0407124 A1 * 12/2020 Caszatt ..... B65D 47/0838
2021/0094733 A1 * 4/2021 Bloom ..... B65D 41/3442
2021/0229873 A1 * 7/2021 Berroa García ... B65D 41/3447
2021/0300648 A1 * 9/2021 Bassi ..... B65D 41/34
2022/0002021 A1 * 1/2022 Krautkramer ..... B65D 55/16
2022/0081171 A1 * 3/2022 Erwin ..... B65D 41/3428
2022/0177188 A1 * 6/2022 Minnette ..... B65D 55/16
2022/0185554 A1 * 6/2022 Falzoni ..... B65D 41/3447
2022/0194673 A1 * 6/2022 Erwin ..... B65D 55/16
2023/0025075 A1 * 1/2023 Leuenberger ..... B65D 41/3447
2023/0041392 A1 * 2/2023 Dangl ..... B65D 41/3428
2023/0042976 A1 * 2/2023 Kainz ..... B65D 55/16
2023/0055070 A1 * 2/2023 Migas ..... B65D 47/0804
2024/0059465 A1 * 2/2024 Falzoni ..... B65D 41/34
2024/0124203 A1 * 4/2024 Bartolomé Gombau ..... B65D 41/34
2024/0286801 A1 * 8/2024 Bucher ..... B65D 41/36
2024/0327079 A1 * 10/2024 Wisniewski ..... B65D 47/0842
2025/0128865 A1 * 4/2025 Krautkrämer ..... B65D 41/3428
2025/0187803 A1 * 6/2025 Scheibenstock ..... B65D 55/16

FOREIGN PATENT DOCUMENTS

DE 202019106993 U1 1/2020
EP 1529736 A2 5/2005
EP 3909884 A1 11/2021
WO 2021146080 A1 7/2021

OTHER PUBLICATIONS

Search Report issued on Feb. 22, 2022, in corresponding German application No. 10 2021 125 520.1; 9 pages.
International Preliminary Report on Patentability issued on Apr. 2, 2024, in corresponding International Application No. PCT/EP2022/076607, 7 pages.

* cited by examiner

CLOSURE DEVICE WITH SUPPORT RING

FIELD

The present invention relates to a closure device for closing a container, wherein the closure device comprises a basic member, wherein the basic member provides a channel extending along a closure axis and having an inlet opening and a pouring opening axially opposite the inlet opening, wherein the pouring opening is arranged in an imaginary pouring plane configured substantially perpendicular to the closure axis, wherein the basic member has a first guide means, wherein the basic member has a fastening means, wherein the closure device comprises a closure cap, wherein the closure cap has a cap lid and a first guide means extending circumferentially on the cap lid and a second guide means extending circumferentially on the closure axis, wherein the basic member has a fastening means, wherein the closure device comprises a closure cap, wherein the closure cap has a cap cover and a first guide means extending circumferentially on the cap lid and a second guide means extending circumferentially on the closure axis, wherein the basic member has a first guide means and a second guide means extending circumferentially on the closure axis and a second guide means extending circumferentially on the closure axis, wherein the basic member has a first guiding means, wherein the basic member has a fastening means, wherein the closure device comprises a closure cap, wherein the closure cap has a cap cover and a cap skirt which adjoins the cap cover on the periphery and extends axially, wherein the closure cap has a second guiding means, wherein the closure cap and the basic member are configured in such a manner that in a closed state of the closure device the first guiding means and the second guiding means are in engagement with each other and the closure cap closes the pouring opening and in an open state of the closure device the first guiding means and the second guiding means are out of engagement and the closure cap opens the pouring opening at least in sections, wherein the closure device comprises an anchor ring and a fastening means, wherein the fastening means connects the anchor ring to the closure cap, wherein the anchor ring is in engagement with the fastening means both in the closed state and in the open state of the closure device in such a way that the closure cap is connected to the basic member by the fastening means and the anchor ring even in the open state.

The present invention also relates to a combination of the closure device with a carton package and a combination of the closure device with a plastic bottle.

BACKGROUND

Closures of the type mentioned at the beginning with an attached closure cap must enable a person consuming to drink or pour from a container equipped with the closure without interference. This requires that the closure cap can be brought into a position in the open state that is practical for the person consuming. It has been shown with the closures known from the prior art that the closure cap often falls back from such a position when drinking or pouring, which disturbs the person consuming.

SUMMARY

Against this background, it is the problem of the present invention to eliminate the aforementioned disadvantages or at least to reduce the risk of these disadvantages occurring.

The problem underlying the invention is solved by a closure device of the type referred to above. According to the invention, the basic member has an additional support means, wherein the support means is arranged axially between the fastening means and the guiding means, wherein the support means has a first surface element with a surface normal, wherein the surface normal points in the direction of the pouring plane, wherein the closure device is configured such that in the open state of the closure device, the closure cap can be brought into a first position. In this first position, the closure cap abuts neither against the first surface element nor against a first edge delimiting the first surface element, wherein the closure cap can be brought into a second position in which the closure cap abuts against the first surface element or against the first edge or against the first surface element and the first edge, wherein the closure cap is mounted in the second position in a stabilised manner relative to the basic member.

For the purposes of the present invention, the presence of an additional support means is to be understood to mean that the support means forms a component of the basic member in addition to the guiding means and in addition to the fastening means. In particular, the support means can be an element that is separate from the fastening means and the guiding means and is not configured integrally with either the fastening means or the guiding means.

In other words, the support means and the fastening means are two separate elements. In particular, the support means and the fastening means are not configured as integral components of a single means, for example not as two different surfaces of a ring element.

The closure cap is stabilised in the second position relative to the basic member if the closure cap does not move out of this position without external force.

The additional support means advantageously enables a reliably stable positioning of the closure cap in the open state.

In one embodiment of the present invention, the surface normal of the first surface element and the pouring plane are perpendicular to each other.

In an alternative embodiment of the present invention, the surface normal of the first surface element and the pouring plane form an angle of between 60 degrees and 90 degrees.

In an alternative embodiment of the present invention, the surface normal of the first surface element and the pouring plane include an angle of between 70 degrees and 85 degrees.

In one embodiment of the present invention, the support means, the connecting device and the closure cap are configured such that a change from the first position of the closure cap to the second position of the closure cap and/or a change from the second position of the closure cap to the first position of the closure cap is only possible by the external action of an additional force.

In one embodiment of the present invention, the support means, the connecting device and the closure cap are configured such that a change from the first position of the closure cap to the second position of the closure cap and/or a change from the second position of the closure cap to the first position of the closure cap is only possible by overcoming a predetermined frictional resistance and/or deformation resistance.

In one embodiment of the present invention, the closure device is configured such that when the closure cap is changed from the first position to the second position and/or when the closure cap is changed from the second position to the first position, a clicking sound audible to the average user is heard.

In one embodiment of the present invention, the closure cap comprises a fixing element, wherein the closure cap and the connecting device are configured such that the fixing element abuts at least the first surface element or the first edge in the open state of the closure device when the closure cap is in the second position, so that a change of this second position can essentially only be brought about by a conscious application of force by a user of the closure device.

In one embodiment of the present invention, the fixing element is preferably an axial extension of the cap skirt in the closed state of the closure device.

In one embodiment of the present invention, the maximum outer radius of the fixing element is not greater than, i.e. less than or equal to, the maximum outer radius(es) of the cap skirt.

In an alternative embodiment of the present invention, the maximum outer radius of the fixing element is greater than the maximum outer radius of the cap skirt.

For the purposes of the present invention, the cap skirt and the fixing element are to be understood as two distinguishable elements of the closure cap, even though in one embodiment of the invention the cap skirt and the fixing element may be configured integrally connected to each other.

In one embodiment of the present invention, the fixing element has an outer surface directed away from the closure axis in the closed state of the closure device, wherein the outer surface of the fixing element abuts at least in sections against the first surface element or the first edge when the closure cap is in the second position in the open state.

In one embodiment of the present invention, the closure device is configured such that in the open state of the closure device the closure cap can be brought into a specific first position, wherein in this specific first position the fixing element is arranged on the side of the support means facing away from the pouring plane.

In one embodiment of the present invention, the support means has a second surface element with a surface normal, wherein the surface normal points in a direction away from the pouring plane, wherein the closure device is configured such that, during an opening movement of the closure cap, the closure cap first comes at least into contact with the second surface element or a second edge delimiting the second surface element before the closure cap can be moved into the second position.

In one embodiment of the present invention, the connection of the connecting device to the anchor ring in the closed state is located closer to the pouring opening than the area of the fixing element at the maximum distance from the pouring opening.

In one embodiment of the present invention, the support means is axially spaced from both the first guiding means and the fastening means.

In one embodiment of the present invention, the support means is a support ring extending over the full circumference of the basic member and projecting radially away from the closure axis, or the support means is a support ring section extending only over a partial area of less than 360 degrees and projecting radially away from the closure axis.

In one embodiment of the present invention, the support means is a support ring or support ring section projecting radially away from the closure axis, wherein the fastening means is a fastening ring or fastening ring section arranged axially spaced from the support ring or support ring section and projecting radially away from the closure axis.

In one embodiment of the present invention, the support means has a maximum radial extent to be measured from the closure axis which is greater than the maximum radial extent of the first guiding means.

In one embodiment of the present invention, the connecting device and the closure cap are configured such that, in the open state, the closure cap is pivotally mounted relative to the basic member about a pivot axis perpendicular to the closure axis.

In one embodiment of the present invention, the connecting device and the closure cap are configured such that the closure cap is pivotally mounted relative to the basic member in the first position about a first pivot axis perpendicular to the closure axis and is pivotally mounted relative to the basic member in the second position about a second pivot axis perpendicular to the closure axis, wherein the first pivot axis is further away from the pouring plane than the second pivot axis.

In one embodiment of the present invention, the connecting device comprises at least a first holding band and an additional second holding band, wherein the first holding band connects the closure cap to the anchor ring, wherein the second holding band connects the closure cap to the anchor ring, wherein the connecting device preferably comprises exclusively a first holding band and an additional second holding band.

In one embodiment of the present invention, at least the first holding band is twisted in the open state of the closure device when the closure cap is in the second position, wherein preferably the first holding band and the second holding band are twisted in the open state of the closure device when the closure cap is in the second position.

In one embodiment of the present invention, the first holding band and the second holding band each extend over a maximum circumferential angle of 120 degrees in the closed state of the closure device.

In one embodiment of the present invention, the first holding band and the second holding band each extend over a maximum circumferential angle of 90 degrees when the closure device is in the closed state.

In one embodiment of the present invention, the first holding band and the second holding band each extend over a maximum circumferential angle of 60 degrees when the closure device is in the closed state.

In one embodiment of the present invention, the first guiding means and the second guiding means are configured and arranged such that the closure cap is rotatably mounted on the basic member relative to the basic member in the closed state of the closure device, so that the closure cap is rotatable in an opening rotational direction relative to the basic member in order to bring the closure device into the open state.

In one embodiment of the present invention, the first guiding means is an external thread, wherein the second guiding means is an internal thread.

In one embodiment of the present invention, the first and second guiding means are configured as interengageable bayonet elements.

In one embodiment of the present invention, the first guiding means and the second guiding means are configured such that the closure cap is configured as a flip-top cap or unidirectional flip-top cap. In this case, the first guiding means and the second guiding means can each be configured as a latching element so that the closure cap can be closed and opened by an exclusive pivoting movement about a pivoting axis that is essentially perpendicular to the closure axis, i.e. without a rotation about the closure axis, or, in the case of a unidirectional flip-top cap, can only be closed but not opened by an exclusive pivoting movement.

In one embodiment of the present invention, the first guiding means and the second guiding means are configured and arranged in such a way that the first guiding means and the second guiding means disengage from the closed state after a maximum rotation of the closure cap by 180 degrees in the opening direction of rotation, so that the closure cap can be brought into the open state without any further rotation of the closure cap in the opening direction of rotation.

In one embodiment of the present invention, the first guiding means and the second guiding means are configured and arranged in such a way that the first guiding means and the second guiding means disengage from the closed state after a maximum rotation of the closure cap by 120 degrees in the opening direction of rotation, so that the closure cap can be brought into the open state without any further rotation of the closure cap in the opening direction of rotation.

In one embodiment of the present invention, the first guiding means and the second guiding means are configured and arranged in such a way that the first guiding means and the second guiding means disengage from the closed state after a maximum rotation of the closure cap by 90 degrees in the opening direction of rotation, so that the closure cap can be brought into the open state without any further rotation of the closure cap in the opening direction of rotation.

Particularly in the case of such short threads with a required rotational movement for opening the closure of less than 180 degrees, the attachment of an additional support means according to the invention, for example in the form of a support ring, is advantageous, since the external thread located on the basic member is in no way suitable for supporting and stabilising the closure cap in the case of such short threads.

In an alternative embodiment of the present invention, the first guiding means and the second guiding means are configured and arranged in such a way that the first guiding means and the second guiding means are disengaged at least after the closure cap has been rotated 360 degrees in the opening direction of rotation from the closed state, so that the closure cap can be brought into the open state without any further rotation of the closure cap in the opening direction of rotation. This embodiment is particularly advantageous in connection with a carton package if the closure device also has a cutting device for opening the carton package. In this case, the greatest possible rotary movement is required in order to move the cutting elements of a cutting device sufficiently far into the carton package via entraining elements.

In one embodiment of the present invention, the area of the basic member defining the channel has a minimum material thickness $d_{min}$ to be measured radially, wherein $d_{min}$ is less than 2 mm.

In one embodiment of the present invention, the material thickness $d_{min}$ is less than 1 mm.

In one embodiment of the present invention, the material thickness $d_{min}$ is between 0.5 mm and 0.8 mm.

In one embodiment of the present invention, the fastening means is a circumferentially extending, radially protruding ring.

In one embodiment of the present invention, the closure device comprises a cutting device with a cutting element arranged at least in sections within the channel, the closure cap comprises an entraining device, wherein the entraining device and the cutting device are configured and arranged such that an initial rotation of the closure cap in the direction of rotation of the opening causes a movement of the cutting element from an initial position of the cutting element in a direction pointing from the pouring opening to the inlet opening, so that the cutting element can be moved at least in sections through the inlet opening.

In one embodiment of the present invention, the closure device has a tamper-evident device, wherein the tamper-evident device provides a first visible or tactile indicator in a first state and provides a second visible or tactile indicator in a second state, which is to be distinguished from the first indicator.

In one embodiment of the present invention, the closure device is configured such that when the closure cap is rotated for the first time in the opening direction of rotation, the tamper-evident device first changes from the first state to the second state at a rotation angle D1 and then the cutting element moves out of the channel through the inlet opening for the first time at a rotation angle D2, so that the rotation angle D2 is greater than the rotation angle D1, both rotation angles D1 and D2 being measured starting from the same rotation angle zero point D0.

In one embodiment of the present invention, the closure device comprises a guarantee ring, wherein the guarantee ring is connected to the anchor ring via at least one easily tearable bridge, wherein the closure device is configured such that the at least one easily tearable bridge tears when the closure device is opened for the first time, wherein the guarantee ring is preferably arranged on the side of the anchor ring facing away from the pouring plane.

In one embodiment of the present invention, the anchor ring is connected to the guarantee ring via at least one tearable bridge before the closure cap is opened for the first time, wherein the anchor ring, the guarantee ring and the at least one tearable bridge are configured in such a way that the at least one tearable bridge can be torn by the initial opening movement of the closure cap, so that the guarantee ring can be detached from the anchor ring, wherein the closure cap is connected to the anchor ring exclusively via the connecting device both before the initial opening movement and after the initial opening movement of the closure cap.

In an alternative embodiment to the aforementioned embodiment, the closure cap is connected to the anchor ring via at least one further tearable bridge before the initial opening movement.

In one embodiment of the present invention, the closure device has a sealing element, wherein the sealing element is arranged at least partially detachably on the basic member, wherein in the open state of the closure device, the sealing element closes the channel in a sealed state and releases the channel in an unsealed state, wherein the sealing element is connected to the basic member in the sealed state and is at least partially detached from the basic member in the unsealed state.

In one embodiment of the present invention, the sealing element is a sealing membrane that can be torn off by a consuming person when the closure device is in the open state.

The present invention also relates to a combination of a carton package with a closure device according to the invention, wherein the closure device is connected to the carton package or is partially configured integrally with the closure device such that the closure device enables the carton package to be opened or closed.

The present invention also relates to a combination of a plastic bottle with a closure device according to the invention, wherein the closure device is connected to the plastic bottle or is partially configured integrally with the plastic bottle such that the closure device enables opening or closing of the carton package, wherein the plastic bottle comprises a bottle neck, wherein the bottle neck comprises the basic member of the closure device.

In one embodiment of the present invention, the combination is configured such that a closure cap pivotable about a pivot axis perpendicular to the closure axis relative to the basic member is pivotable by a maximum of 180 degrees, preferably by a maximum of 170 degrees, before contact between the carton package or plastic bottle on the one hand and the closure cap or connecting device on the other hand prevents pivoting beyond this.

In one embodiment of the present invention, the combination is configured in such a way that a mere pivoting movement of the closure cap from the first position to the second position and before reaching the second position causes the closure cap and an outer surface of the carton package or the plastic bottle to come into contact.

In one embodiment of the present invention, the combination is configured such that the contact between the closure cap and the outer surface of the carton package or the plastic bottle facilitates the targeted movement of the closure cap into the second position for the person consuming the product. Accordingly, a small amount of force is required to reach the second position of the closure cap, as the closure cap is supported by the carton package or plastic bottle, whereby a leverage effect can be utilised.

BRIEF DESCRIPTION OF THE FIGURES

Further embodiments, features, advantages and uses of the present inventions will become apparent from the figures discussed below. These show.

DETAILED DESCRIPTION

Figure 5:
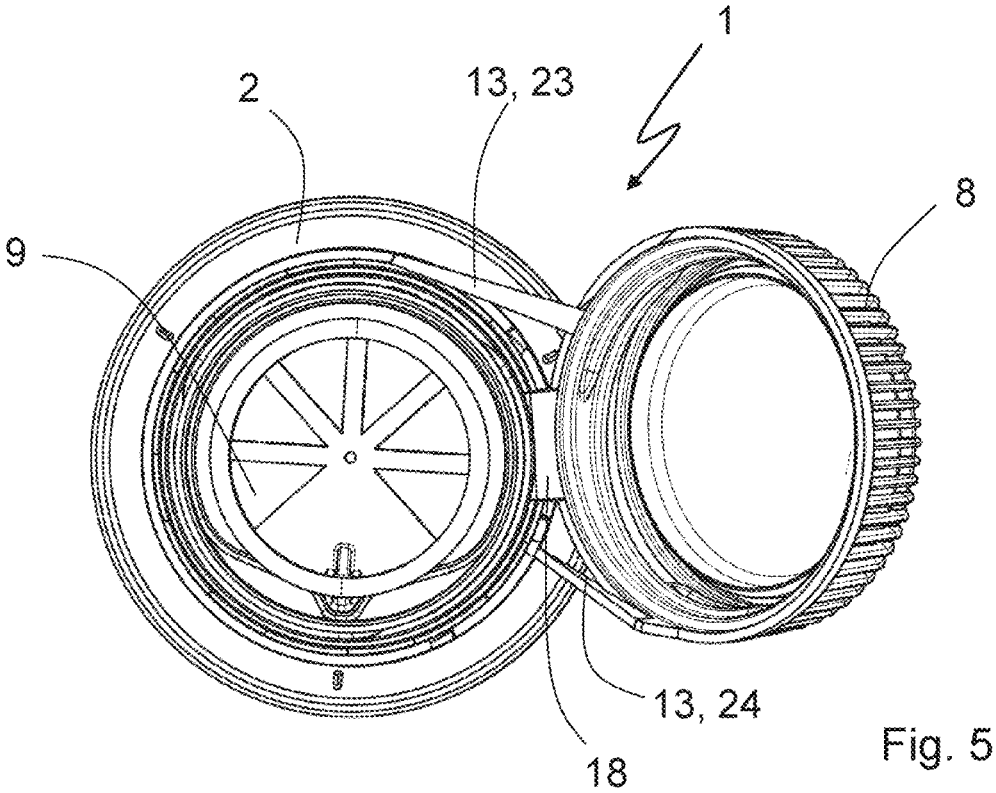
FIG. 5: a plan view from above of the first embodiment of the closure device according to the invention shown in FIG. 1 in the open state of the closure device.

The first embodiment of a closure device 1 according to the invention shown in FIG. 1 to FIG. 5 has a connecting device 13 with two holding bands, namely a first holding band 23 and a second holding band 24, and a fixing element 18. Before the closure device 1 is opened for the first time, the two holding bands 23, 24 are connected to the anchor ring 12 on the one hand and to the cap skirt 10 on the other hand via a total of two weakening lines 25, 26. When the closure device 1 is opened for the first time, these two weakening lines 25, 26 tear, so that the closure cap 8, as shown in FIGS. 3*a*, 3*b*, 5 and 5, remains attached to the basic member 2 via the two holding bands 23, 24—namely via the anchor ring 12—even when the closure cap 8 is lifted off in order to release the pouring opening 5.

For the purposes of the present application, a weakening line is a special formation of an easily tearable bridge and thus also provides a tamper-evident device.

Figure 1:
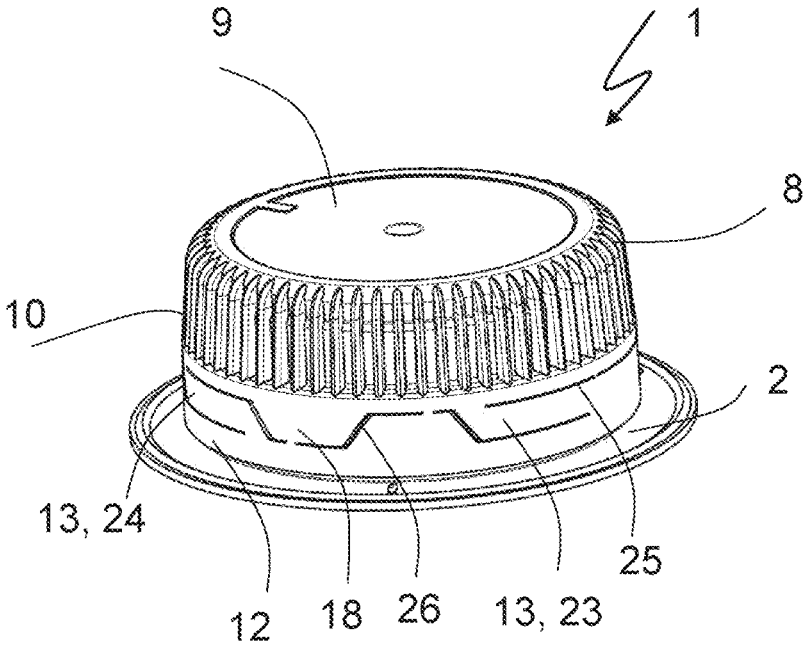
FIG. 1: a perspective view of a first embodiment of the closure device according to the invention in the closed state of the closure device.

In the embodiment shown in FIGS. 1 to 5, the two weakening lines 25 and 26 are configured such that, before the closure device 1 is opened for the first time, a first weakening line 25 connects the first holding band 23 to the cap skirt 10 and the second holding band 24 to the anchor ring 12, and that a second weakening line 26 connects the first holding band 23 to the anchor ring 12 and the second holding band 24 to the cap skirt 10. As can be seen in FIG. 1, the second weakening line 26 extends from a position on the second holding band 24 that is axially spaced from the first weakening line 25 in the direction of the pouring opening 5, sometimes also axially towards a position on the first holding band 23 that is axially spaced from the first weakening line 25 in the direction of the inlet opening 4.

The second weakening line 26 extends in a zig-zag manner, so that in the closed state of the closure device 1 a fixing element 18 is formed at a circumferential position between the two circumferential ends of the first weakening line 25, which is arranged on the cap skirt 10 as an axial extension of the cap skirt 10. The fixing element 18 and cap skirt 10 are configured in one piece. The cap skirt 10 and fixing element 18 are also essentially flush in the radial direction.

Figure 2:
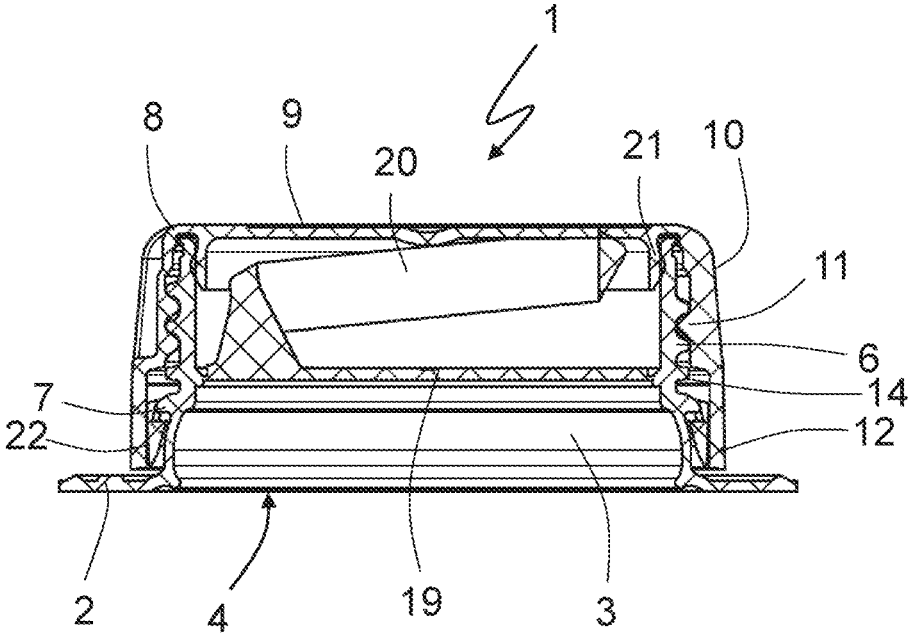
FIG. 2: a sectional view of the first embodiment of the closure device according to the invention shown in FIG. 1 in the closed state of the closure device.
Figure 3A:
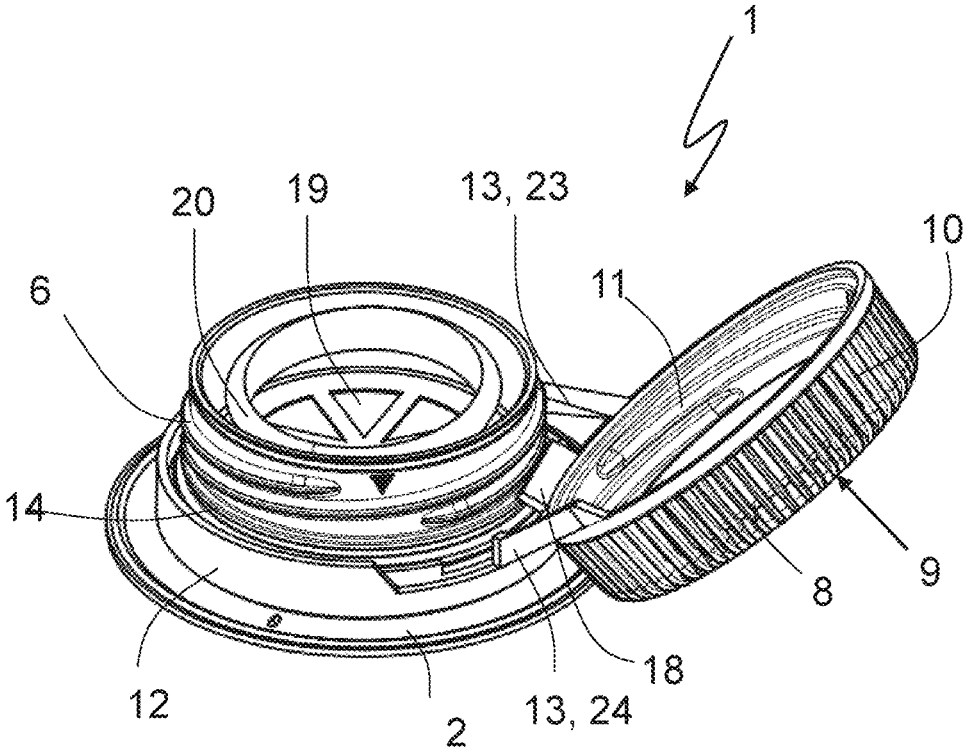
FIG. 3*a*: a first perspective view of the first embodiment of the closure device according to the invention shown in FIG. 1 in the open state of the closure device.
Figure 3B:
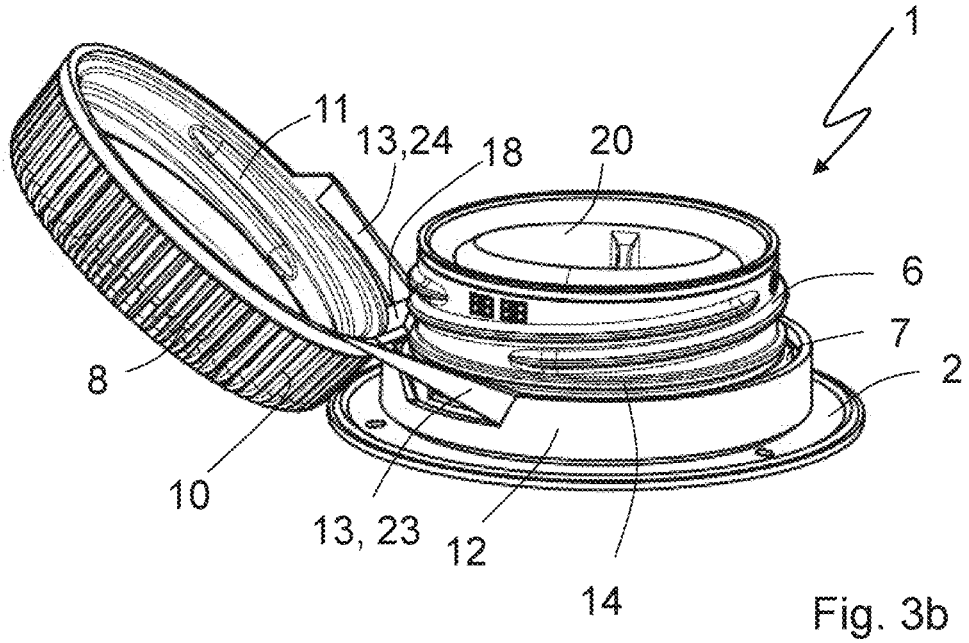
FIG. 3*b*: a second perspective view of the first embodiment of the closure device according to the invention shown in FIG. 1 in the open state of the closure device.
Figure 4:
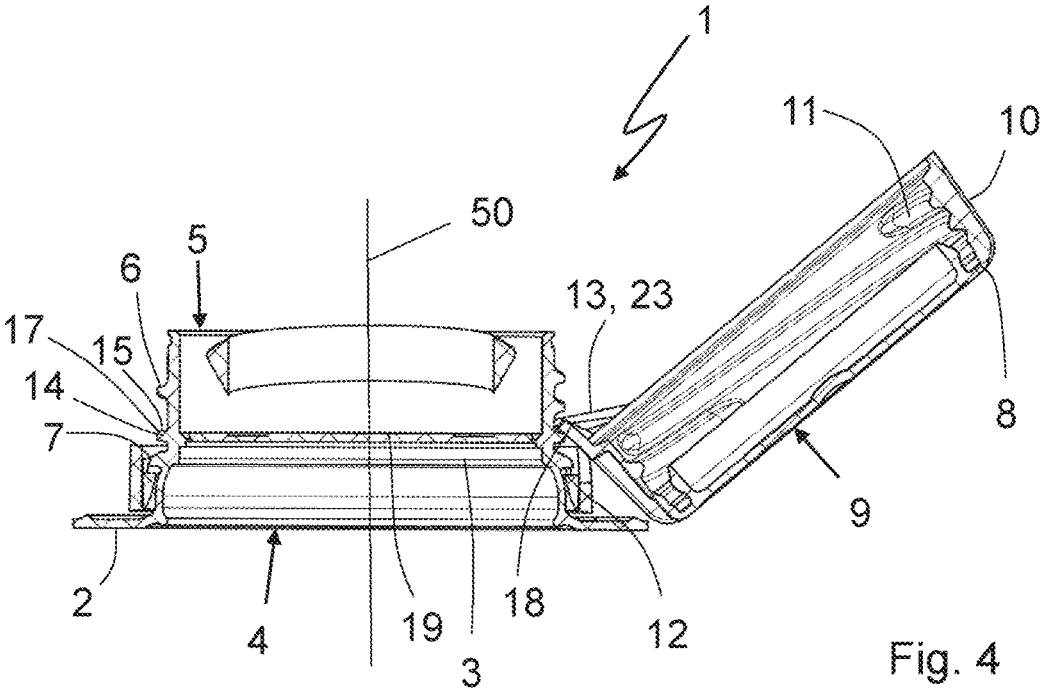
FIG. 4: a sectional view of the first embodiment of the closure device according to the invention shown in FIG. 1 in the open state of the closure device.

After the closure device 1 is opened for the first time, the closure cap 8 is pivoted out of the position shown in FIGS. 1 and 2 in order to bring it into the second, stabilised position of the closure cap 8 shown in FIGS. 3*a*, 3*b*, 4 and 5. The holding bands 23 and 24 are twisted by pivoting. The twisted holding bands cause a restoring torque which, without the presence of the support means 14 configured as a support ring, would cause the closure cap 8 to pivot at least partially back in the direction of the pouring opening 5. However, in the first embodiment of the closure device 1 shown here, the fixing element 18 initially comes into contact with the surface of the support means 14 aligned in the direction of the inlet opening 4 during pivoting. By applying a slightly increased torque, the person consuming the product then ensures that the fixing element 18 is lifted or pressed out of this position in the direction of the pouring opening 5 over the support ring, whereby a clearly audible clicking sound is emitted in the course of this. As a result, the fixing element 18 is in the position shown in FIG. 3*a*. In the embodiment shown here, this means that the fixing element abuts with its outer surface against the first edge 17 of the support ring. In this position, the support of the fixing element 18 on the first edge 17 of the support ring counteracts the restoring torque caused by the twisted holding bands, so that the closure cap 8 cannot be moved out of this position without the application of increased force by the person consuming it and is thus mounted in a stabilised manner.

Axially spaced from the support ring in the direction of the inlet opening 4, the basic member 2 has the fastening means 7 configured as a fastening ring, more precisely as a pilfer-proof ring. This fastening ring holds the anchor ring 12 and thus also the closure cap 8, which is connected to the anchor ring 12 via the connecting device 13, attached to the basic member 2. In the first embodiment shown in FIGS. 1 to 5, the anchor ring is configured as a flex band.

A flex band section of the anchor ring that is folded over in the direction of the closure axis 50 is in engagement with the fastening means 7.

The embodiment shown in FIGS. 1 to 5 also has an asymmetrical position of the two holding bands 23 and 24 in relation to each other when the closure cap 8 is in the second position. This can be seen in particular in FIG. 5.

For the purposes of the present application, an asymmetrical position of two holding bands is to be understood as an arrangement of two holding bands in which the connection point between the first of the two holding bands and the anchor ring is arranged closer (or further away, depending on the definition of the holding bands) to the closure cap than the connection point between the second of the two holding bands and the anchor ring.

The first guiding means 6 of the embodiment of the closure device 1 according to the invention shown in FIGS. 1 to 5 is configured as an external thread and the second guiding means 11 as a corresponding internal thread, whereby a rotation through a circumferential angle of approximately 180 degrees is necessary in order to disengage the external and internal threads from a fully closed position or to bring them fully into engagement with one another.

It can be seen from FIGS. 2 to 5 that the embodiment shown here also has a sealing membrane 19 initially closing the channel. A pull-off tab 20 is arranged on the sealing membrane 19. To release the channel 3, a person consuming the product only has to grasp the pull-off tab 20 with one finger and pull it upwards with the usual everyday force to separate the sealing membrane 19 from the inside of the channel.

It can be seen from FIGS. 1 and 2 that an annular inner seal 21 extends from the inside of the cap cover 9 in the direction of the inlet opening 4 when the closure device 1 is in the closed state, the inner seal 21—in precisely this state—abutting in a sealing manner against an inner surface of the basic member 2 pointing towards the closure axis 50 in order to seal the channel 3 in a liquid-tight manner even when the sealing membrane 19 also shown here has been removed.

The second embodiment shown in FIGS. 6 to 10 differs from the first embodiment shown in FIGS. 1 to 5 only with regard to the geometry of the weakening lines and with regard to the design of the first and second guiding means. Therefore, only these differences will be discussed below. The remaining features and advantages of the second embodiment shown in FIGS. 6 to 10 correspond to the features and advantages already described for the embodiment shown in FIGS. 1 to 5.

Figure 6:
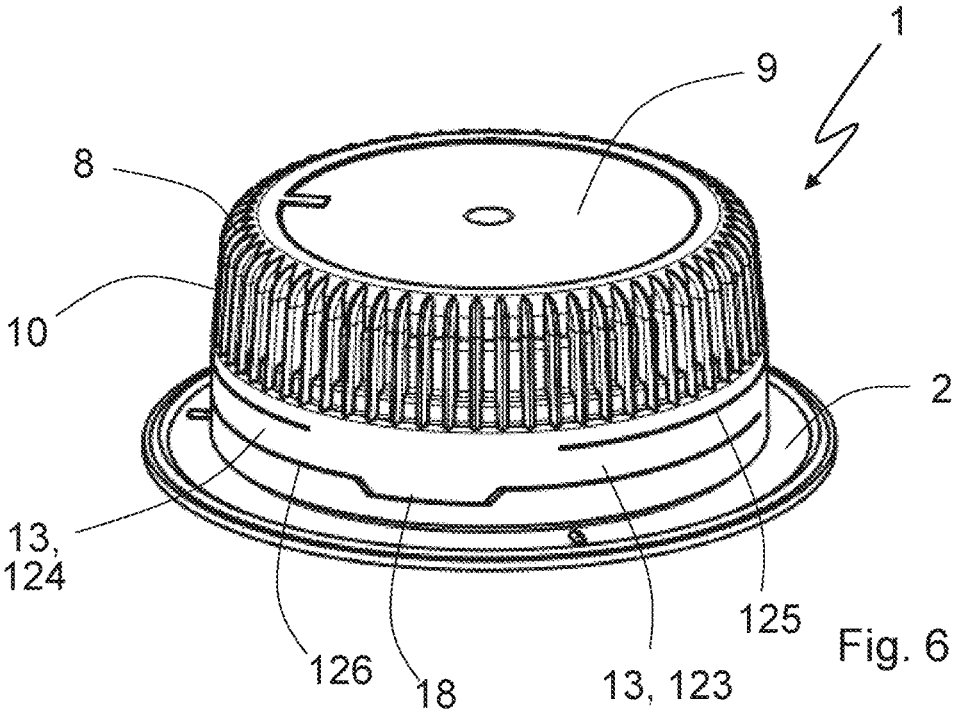
FIG. 6: a perspective view of a second embodiment of the closure device according to the invention in the closed state of the closure device.
Figure 7:
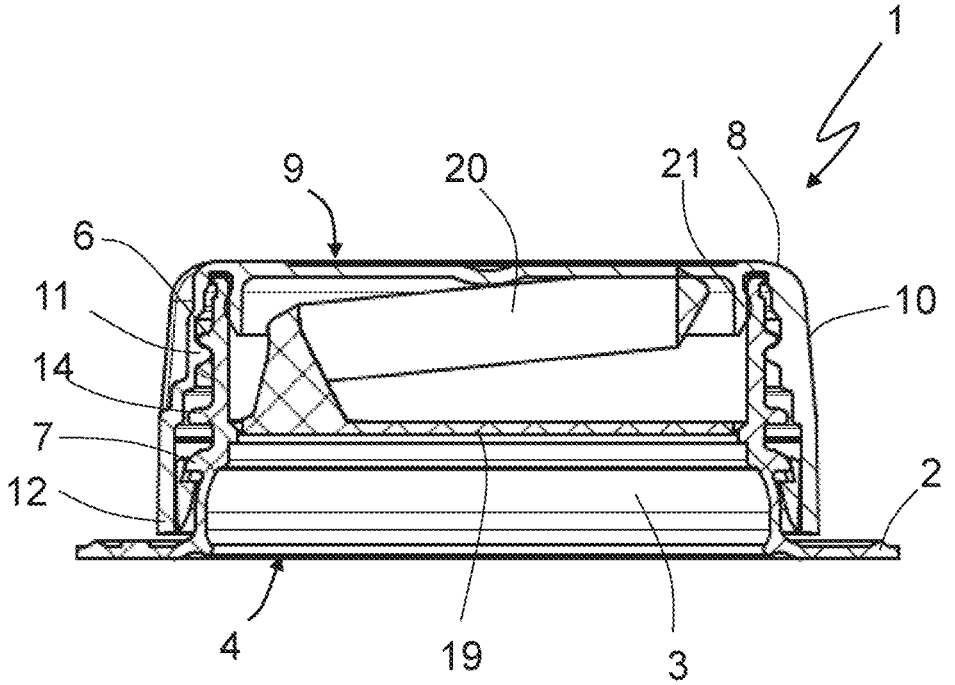
FIG. 7: a sectional view of the second embodiment of the closure device according to the invention shown in FIG. 6 in the closed state of the closure device.
Figure 8A:
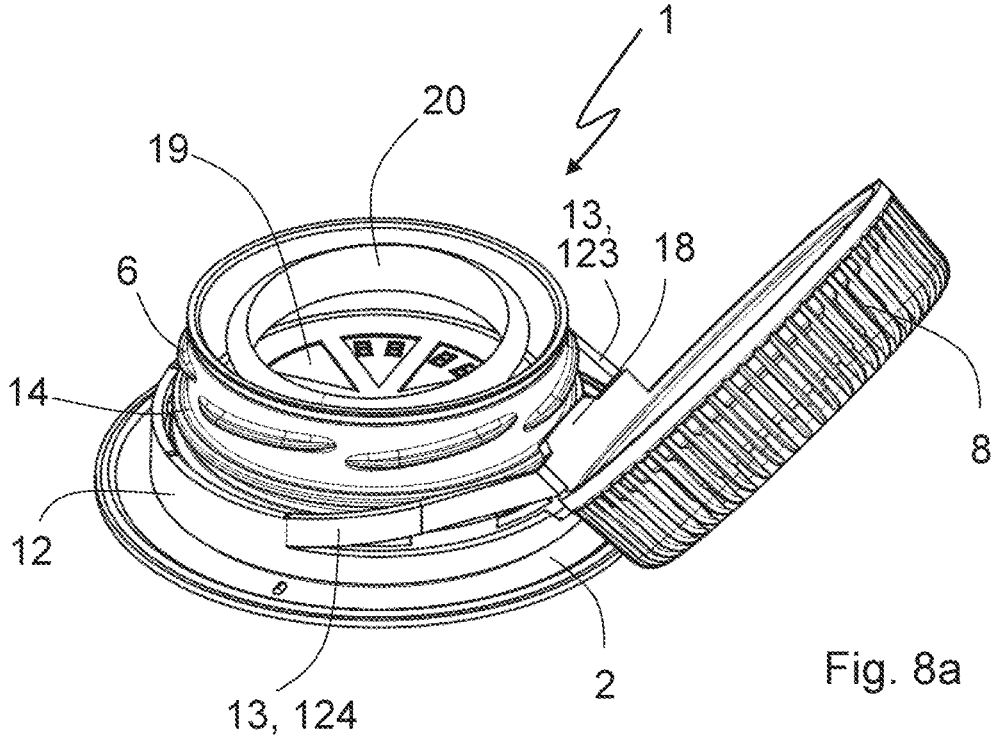
FIG. 8*a*: a first perspective view of the second embodiment of the closure device according to the invention shown in FIG. 6 in the open state of the closure device.
Figure 8B:
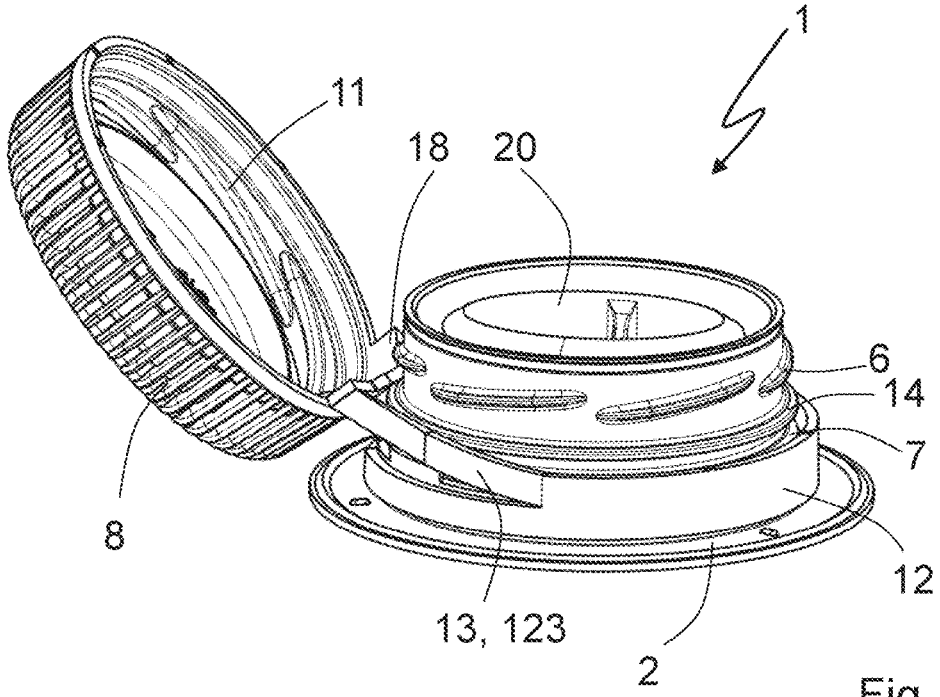
FIG. 8*b*: a second perspective view of the second embodiment of the closure device according to the invention shown in FIG. 6 in the open state of the closure device.
Figure 9:
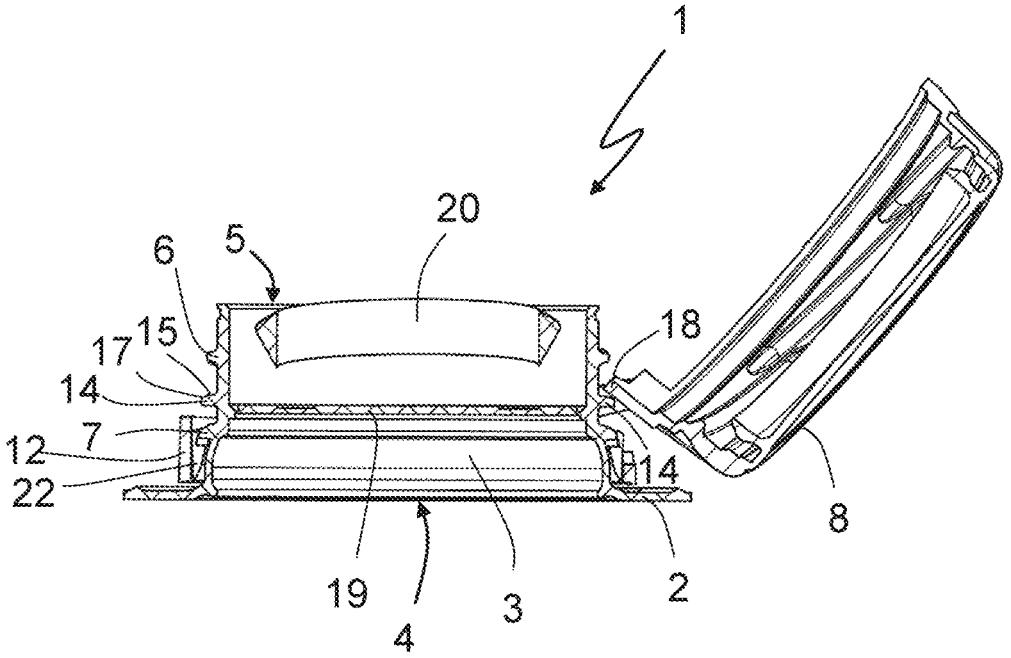
FIG. 9: a sectional view of the second embodiment of the closure device according to the invention shown in FIG. 6 in the open state of the closure device.
Figure 10:
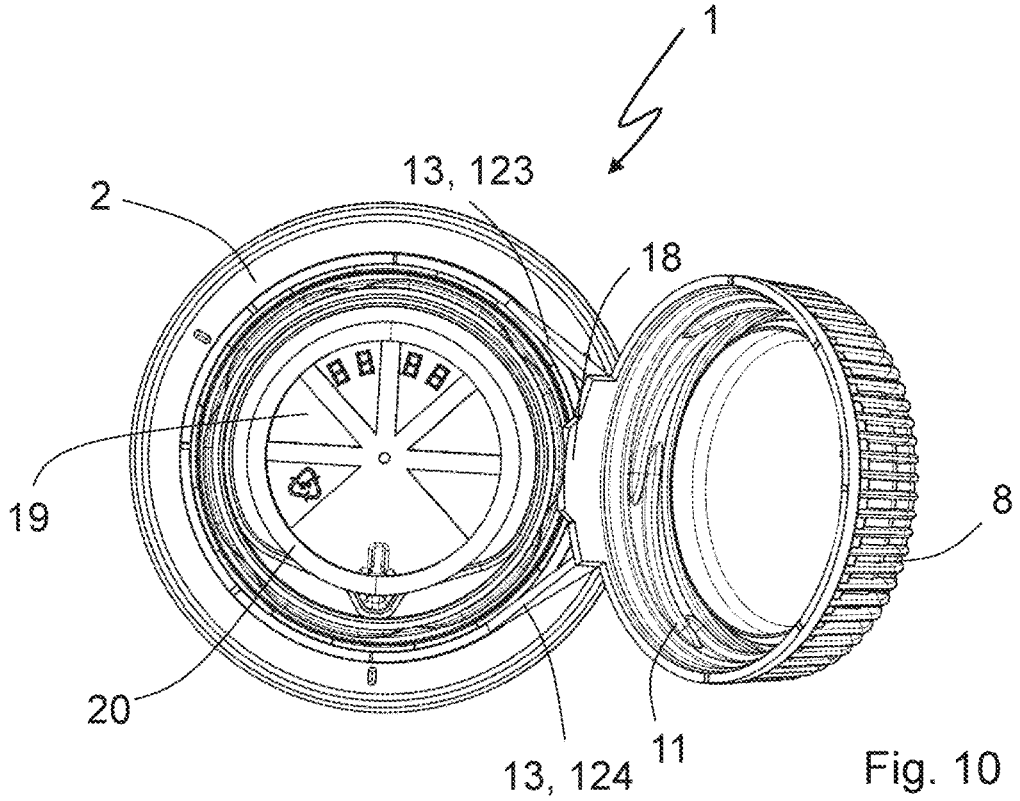
FIG. 10: a top view of the second embodiment of the closure device according to the invention shown in FIG. 6 in the open state of the closure device.

In particular, it can be seen in FIG. 6 that in the second embodiment, a first holding band 123 and a second holding band 124 are also characterised by a first weakening line 125 and a second weakening line 126. In contrast to the first embodiment, however, the two weakening lines 125 and 126 in this case always extend axially spaced apart from one another, each of the two weakening lines 125 and 126 being interrupted by a separating web. As a result, two symmetrically connected holding bands 123 and 124 are formed after the weakening lines 125 and 126 are torn. This means that the connection points of the two holding bands 123 and 124 to the anchor ring 12 are both at essentially the same distance from the closure cap 8.

The second weakening line 126 has a bulge projecting towards the inlet opening 4 in the area of the separating web of the first weakening line 125. As a result, the separating web of the first weakening line 125, which forms the fixing element 18, extends further in the direction of the inlet opening 4 than the connection points between the respective holding bands 123, 124 and the anchor ring 12. This advantageously causes the fixing element 18 to abut particularly firmly against the support ring in the second position. In other words, there is a stronger latching between the support means 14 and the fixing element 18—namely due to the axially elongated design of the fixing element 18 in the direction of the inlet opening beyond the axial position of the connection points between the holding bands 123, 124 and the anchor ring 12.

The embodiment shown in FIGS. 6 to 10 also differs from the embodiment shown in FIGS. 1 to 5 in that the first and second guiding means 6, 11 configured as external and internal threads are shorter in the circumferential direction, namely such that the external and internal threads are disengaged after the closure cap has been rotated by approximately 60 degrees from the fully closed position.

LIST OF REFERENCE SYMBOLS

1 Closure device
2 Basic member
3 Channel
4 Inlet opening
5 Pouring opening
6 First guiding means
7 Fastening means
8 Closure cap
9 Cap cover
10 Cap skirt
11 Second guiding means
12 Anchor ring
13 Connecting device
14 Support means
15 First surface element
17 First edge
18 Fixing element
19 Sealing membrane
20 Pull-off tab
21 Inner seal
22 Foldable flex band section
23 First holding band of the first embodiment
24 Second holding band of the first embodiment

25 First weakening line of the first embodiment
26 Second weakening line of the first embodiment
50 Closure axis
123 First holding band of the second embodiment
124 Second holding band of the second embodiment
125 First weakening line of the second embodiment
126 Second weakening line of the second embodiment

The invention claimed is:

1. A closure device for closing a container,
wherein the closure device comprises a basic member,
wherein the basic member provides a channel extending along a closure axis with an inlet opening and a pouring opening axially opposite the inlet opening,
wherein the pouring opening is arranged in an imaginary pouring plane configured substantially perpendicular to the closure axis,
wherein the basic member comprises a first guiding means,
wherein the basic member comprises a fastening means,
wherein the closure device comprises a closure cap,
wherein the closure cap has a cap cover and an axially extending cap skirt adjoining the cap cover on a circumferential side,
wherein the closure cap has a second guiding means,
wherein the closure cap and the basic member are configured such that
in a closed state of the closure device, the first guiding means and the second guiding means are in engagement with one another and the closure cap closes the pouring opening, and
in an open state of the closure device, the first guiding means and the second guiding means are disengaged and the closure cap releases the pouring opening at least in sections,
wherein the closure device comprises an anchor ring and a connecting device,
wherein the connecting device connects the anchor ring to the closure cap,
wherein the anchor ring is in engagement with the fastening means both in the closed state and in the open state of the closure device in such a way that the closure cap is connected to the basic member by the connecting device and the anchor ring even in the open state,
wherein the basic member has an additional support means,
wherein the additional support means is arranged axially between the fastening means and the first guiding means,
wherein the additional support means has a first surface element with a surface normal,
wherein the surface normal points in the direction of the pouring plane,
wherein the closure device is configured such that, in the open state of the closure device, the closure cap can be brought into a first position in which the closure cap abuts neither against the first surface element nor against a first edge delimiting the first surface element, and can be brought into a second position in which the closure cap abuts against the first surface element or against the first edge or against the first surface element and the first edge,
wherein the closure cap is mounted in the second position in a stabilised manner relative to the basic member.

2. The closure device according to claim 1,
wherein the support means, the connecting device and the closure cap are configured in such a way that a change from the first position of the closure cap to the second position of the closure cap and/or a change from the second position of the closure cap to the first position of the closure cap is only possible by an external action of an additional force.

3. The closure device according to claim 1,
wherein the closure device is configured such that when the closure cap is changed from the first position to the second position and/or when the closure cap is changed from the second position to the first position, a clicking sound audible to the average user is heard.

4. The closure device according to claim 1,
wherein the closure cap comprises a fixing element,
wherein the closure cap and the connecting device are configured such that the fixing element abuts at least against the first surface element or against the first edge in the open state of the closure device when the closure cap is in the second position, so that a change in this second position can essentially only be brought about by a conscious application of force by a user of the closure device,
wherein the fixing element preferably represents an axial extension of the cap skirt in the closed state of the closure device,
wherein particularly preferably the maximum outer radius of the fixing element is not greater than the maximum outer radius of the cap skirt.

5. The closure device according to claim 4,
wherein the connection of the connecting device to the anchor ring in the closed state is located closer to the pouring opening than the area of the fixing element at the maximum distance from the pouring opening.

6. The closure device according to claim 1,
wherein the support means is arranged axially spaced from both the first guiding means and the fastening means.

7. The closure device according to claim 1,
wherein the support means is a support ring extending over the full circumference of the basic member and projecting radially away from the closure axis, or the support means is a support ring section extending only over a partial area of less than 360 degrees and projecting radially away from the closure axis.

8. The closure device according to claim 1,
wherein the support means has a maximum radial extension, to be measured from the closure axis, which is greater than the maximum radial extension of the first guiding means.

9. The closure device according to claim 1,
wherein the connecting device and the closure cap are configured such that the closure cap in the open state is pivotally mounted relative to the basic member about a pivot axis perpendicular to the closure axis.

10. The closure device according to claim 1,
wherein the connecting device comprises at least a first holding band and an additional second holding band,
wherein the first holding band connects the closure cap to the anchor ring,
wherein the second holding band connects the closure cap to the anchor ring,
wherein the connecting device preferably exclusively comprises a first holding band and an additional second holding band.

11. The closure device according to claim 10,
wherein at least the first holding band is twisted in the open state of the closure device when the closure cap is in the second position, wherein preferably the first holding band and the second holding band are twisted in the open state of the closure device when the closure cap is in the second position.

12. The closure device according to claim 10, wherein the first holding band and the second holding band each extend over a circumferential angle of at most 120 degrees, preferably at most 90 degrees and particularly preferably at most 60 degrees in the closed state of the closure device.

13. The closure device according to claim 1, wherein the first guiding means and the second guiding means are configured and arranged such that, in the closed state of the closure device, the closure cap is mounted on the basic member so as to be rotatable about the closure cap relative to the basic member, so that the closure cap is rotatable in an opening direction relative to the basic member in order to bring the closure device into the open state.

14. The closure device according to claim 13, wherein the first guiding means and the second guiding means are configured and arranged in such a way that the first guiding means and the second guiding means disengage at most after a rotation of the closure cap by 180 degrees in the opening direction of rotation out of the closed state, so that the closure cap can be brought into the open state without any further rotation of the closure cap in the opening direction of rotation.

15. A combination of a carton package with a closure device according to claim 1, wherein the closure device is connected to the carton package or is partially configured integrally with the closure device in such a way that the closure device enables the carton package to be opened or closed, or a plastic bottle with the closure device, wherein the closure device is connected to the plastic bottle or is partially configured integrally with the plastic bottle in such a way that the closure device enables opening or closing of the plastic bottle, wherein the plastic bottle has a bottle neck, wherein the bottle neck is or comprises the basic member of the closure device.

16. The combination according to claim 15, wherein the combination is configured such that a closure cap pivotable about a pivot axis perpendicular to the closure axis relative to the basic member is pivotable by a maximum of 180 degrees, preferably by a maximum of 170 degrees, before contact between the carton package or plastic bottle on the one hand and the closure cap or connecting device on the other hand prevents the closure cap from pivoting beyond this.

17. The combination according to claim 15, wherein the combination is configured such that a mere pivoting movement of the closure cap from the first position into the second position and before reaching the second position causes the closure cap and an outer surface of the carton package or the plastic bottle to come into contact, wherein preferably the combination is configured such that the closure cap coming into contact with the outer surface of the carton package or the plastic bottle facilitates guiding the closure cap into the second position for the consuming person.

* * * * *